US005303776A

United States Patent [19]

Ryan

[11] Patent Number: 5,303,776

[45] Date of Patent: Apr. 19, 1994

[54] DEVICE FOR A DOWN-HOLE ASSEMBLY

[75] Inventor: Fred Ryan, Kinellar, Great Britain

[73] Assignee: Pipe Recovery Consultants Limited, Aberdeenshire, United Kingdom

[21] Appl. No.: 927,392

[22] PCT Filed: Nov. 26, 1991

[86] PCT No.: PCT/GB91/02085

§ 371 Date: Sep. 25, 1992

§ 102(e) Date: Sep. 25, 1992

[87] PCT Pub. No.: WO92/09785

PCT Pub. Date: Jun. 11, 1992

[30] Foreign Application Priority Data

Nov. 27, 1990 [GB] United Kingdom ..... 9025763

[51] Int. Cl.[5] ..... E21B 33/072

[52] U.S. Cl. ..... 166/361; 166/298; 166/55.8; 166/66.4; 166/147; 175/269

[58] Field of Search ..... 166/55.8, 65.1, 66.4, 166/100, 134, 147-150, 297, 298, 361; 175/269

[56] References Cited

U.S. PATENT DOCUMENTS

| | | | |
|---|---|---|---|
| 2,399,766 | 5/1946 | Steward . | |
| 2,880,804 | 4/1959 | Fredd | 166/55.8 |
| 2,893,492 | 7/1959 | Brown | 166/119 |
| 2,899,000 | 8/1959 | Medders et al. | 166/55.8 |
| 3,338,305 | 8/1967 | Pittman et al. | 166/361 X |
| 3,381,751 | 5/1968 | McLelland | 166/65.1 |
| 3,664,416 | 5/1972 | Nicolas et al. | 166/212 X |
| 5,139,098 | 8/1992 | Blake | 175/269 |

*Primary Examiner*—Ramon S. Britts
*Assistant Examiner*—Roger J. Schoeppel
*Attorney, Agent, or Firm*—Sixbey, Friedman, Leedom & Ferguson

[57] ABSTRACT

A wireline conveyable device for a fluid operable borehole tubing assembly comprising a tubular body having a first end intended to form the upper end when in the borehole and a second open end intended to form the lower end. The tubular body includes at least one aperture in a wall thereof to facilitate passage of fluid through the tubular body. Electrically actuable outwardly moving anchoring means are attached to the tubular body for positively locating the tubular member at a predetermined position within the borehole tubing, in use. An electrically actuable sealing means attached to the tubular body and arranged, in use, for selectively sealing the space between the borehole tubing and the tubular body to divert fluid through the tubular body to bypass the sealing means for driving fluid actuable means located adjacent said second lower end of the tubular body.

14 Claims, 6 Drawing Sheets

DEVICE FOR A DOWN-HOLE ASSEMBLY

Figure 1:
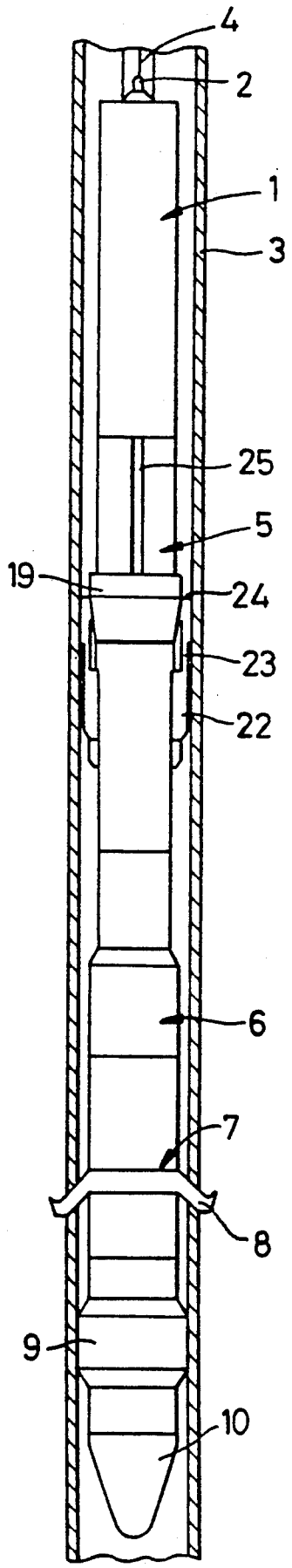

This invention relates to a device conveyable on a wire particularly but not exclusively for a down-hole fluid operable assembly. More particularly the device is for a cutter assembly.

Heretofore when a length of tubing of a gas or oil well had to be removed, the tubing would be severed or cut by explosive or chemical type cutting assemblies which were by their very nature dangerous to handle, transport and use. Assemblies using hydraulic fluid cutters are known. They are safer, but are conveyed down-hole by lengths of tubing or coil tubing of a sufficiently small diameter to fit into the tubing to be cut. The fluid to operate the cutters is pumped down the center of the tool via the coil tubing. This method can take many hours, during which time the oil or gas well would be out of operation.

It is an object of the present invention to provide a fast and safe means for cutting lengths of down-hole tubing.

It is a further object of the present invention to provide a more stable down-hole assembly, particularly a cutting assembly.

According to a first aspect of the present invention there is provided a wireline conveyable device for a fluid operable borehole tubing assembly comprising a tubular body having a first end intended to form the upper end when in the borehole and a second open end intended to form the lower end, the tubular body including at least one aperture in a wall thereof to facilitate passage of fluid through the tubular body, electrically actuable outwardly moving anchoring means attached to the tubular body for positively locating the tubular member at a predetermined position within the bore tubing, in use, and an electrically actuable sealing means attached to the tubular body and arranged, in use, for selectively sealing the space between the borehole tubing and the tubular body to divert fluid through the tubular body to by pass the sealing means for driving fluid actuable means located adjacent said second lower end of the tubular body.

Since wireline is used, a fluid operated assembly such as a cutting assembly can now be conveyed and retracted from the borehole much faster than heretobefore.

The anchoring means can be independent of the sealing means but preferably it is carried by the anchoring means which is movable outwardly from the tubular body to form an anchoring and sealing engagement with the inner wall of the borehole tubing.

More preferably the combined anchoring and sealing means includes a plurality of outwardly deflectable members spaced around the outside of the tubular body, said members being fixed at a lower end to the tubular body and spaced therefrom at their upper end; an electrically actuable actuator including an annular deflector member slidably attached to the outside of the body and engagable on downward movement thereof with the upper ends of the deflectable members to deflect same outwardly into anchoring contact with the inner wall of the borehole tubing; and an annular sealing member carried by the upper ends of the deflectable members and engagable in sealing contact between the deflector member on downward movement thereof, and the inner wall of the borehole tubing, to form in use the sealing means.

In accordance with a second aspect of the invention there is provided a wireline conveyable device for a fluid operable borehole device comprising a body having first and second ends intended, in use, to form the upper and lower ends respectively; and an electrically actuable outwardly movable anchoring means attached to the tubular body arranged, in use, for anchoring the body of the device to the inner wall of the borehole.

A fluid operable down-hole assembly including the anchoring and or sealing device of the first or second aspects of the invention forms a further aspect of the invention.

The wireline conveyable device of the invention is actuable by means of a signal or power which is passed down the wireline and electrically actuable should be construed with reference thereto. In a preferred embodiment of the invention the signal or power passed through the wireline operates an electric motor which actuates the sealing and anchoring means. Alternatively the sealing and anchoring means can be actuated electromagnetically.

The invention will now be described by way of example only with reference to the accompanying drawings in which:

FIG. 1—is a longitudinal section through an oil or gas borehole tubing (sectioned) to show an electric wireline conveyed hydraulically operated inside cutter assembly (unsectioned).

Figure 2:
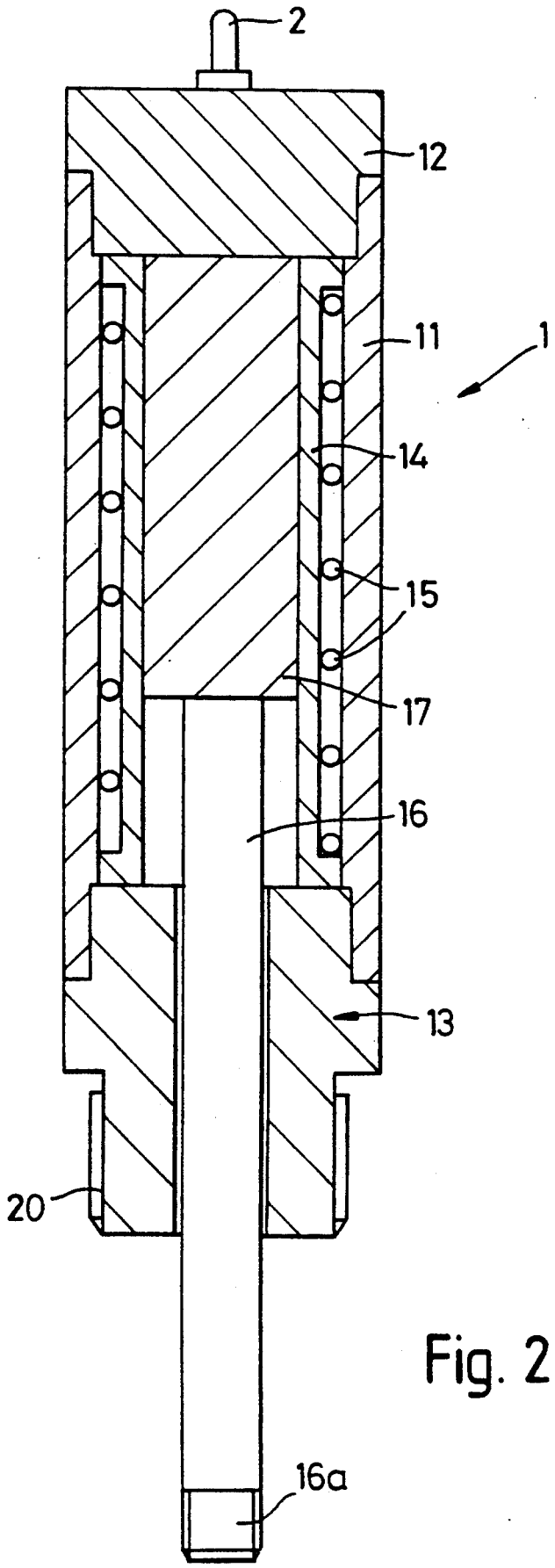
Figure 3:
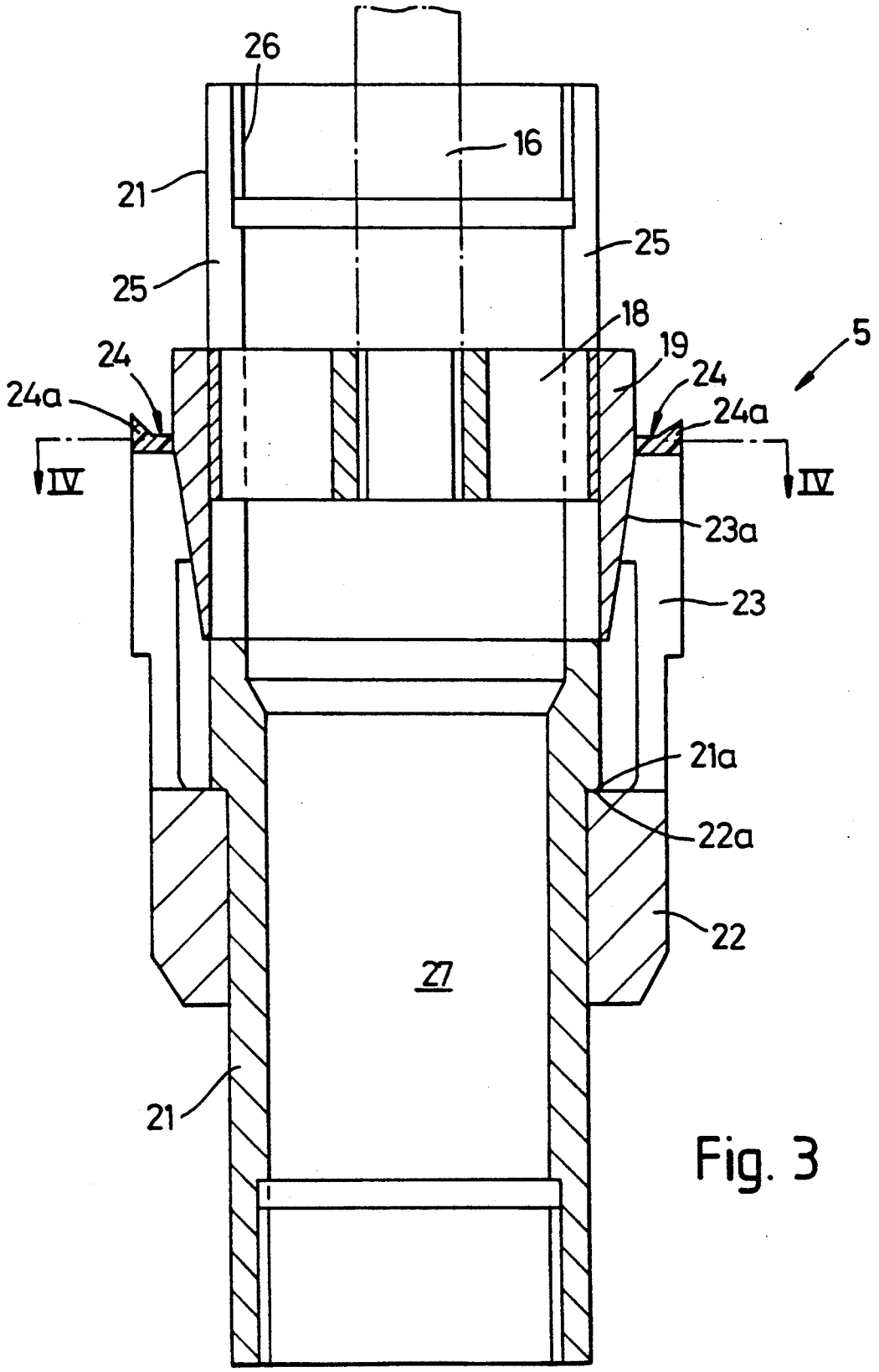
Figure 4:
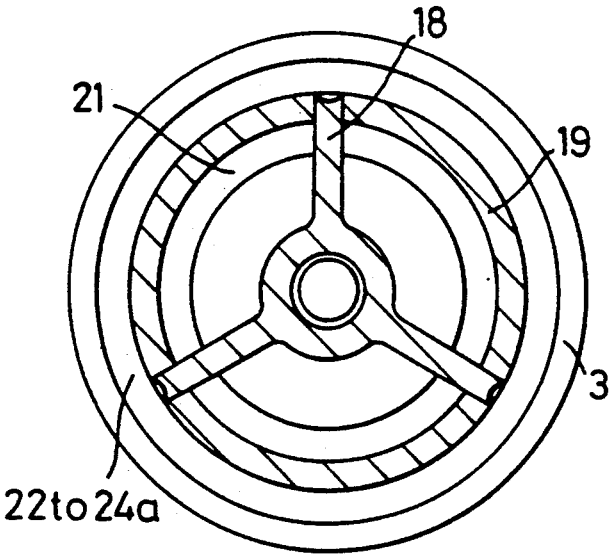
Figure 5:
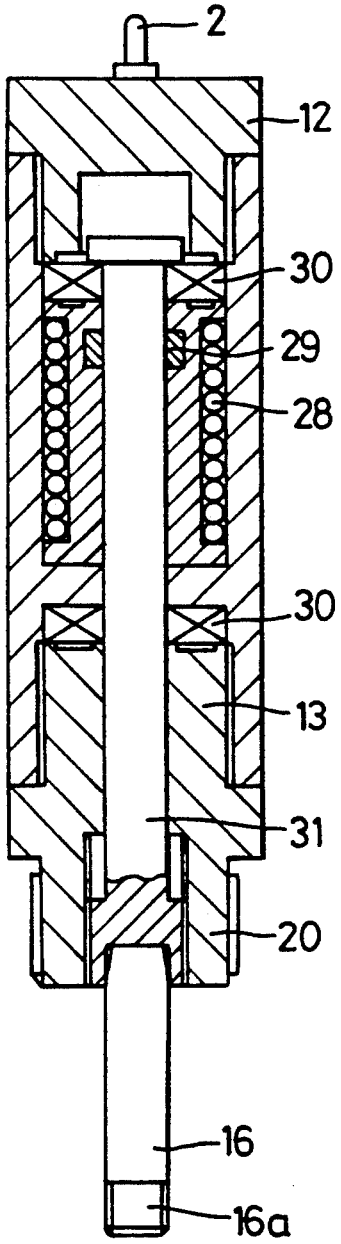
Figure 6A:
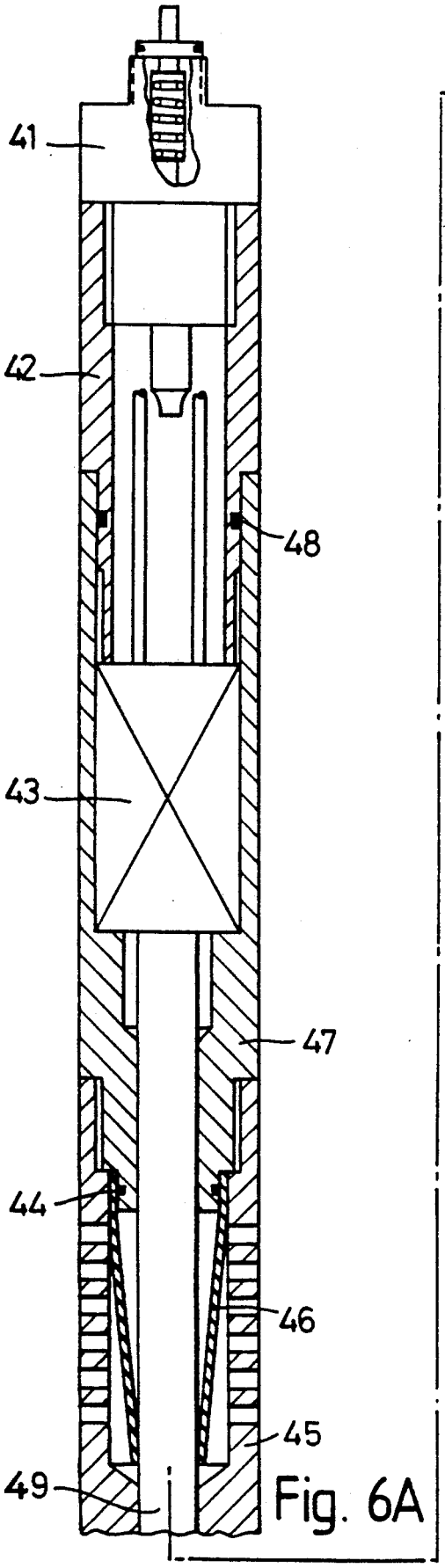
Figure 6B:
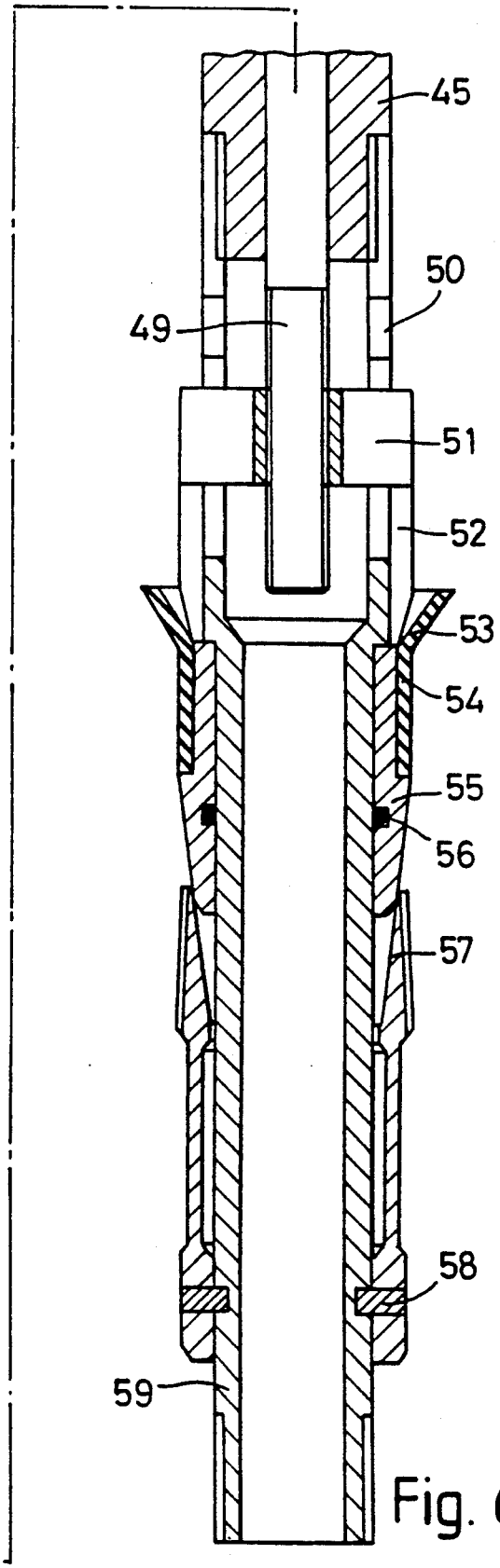
Figure 7:
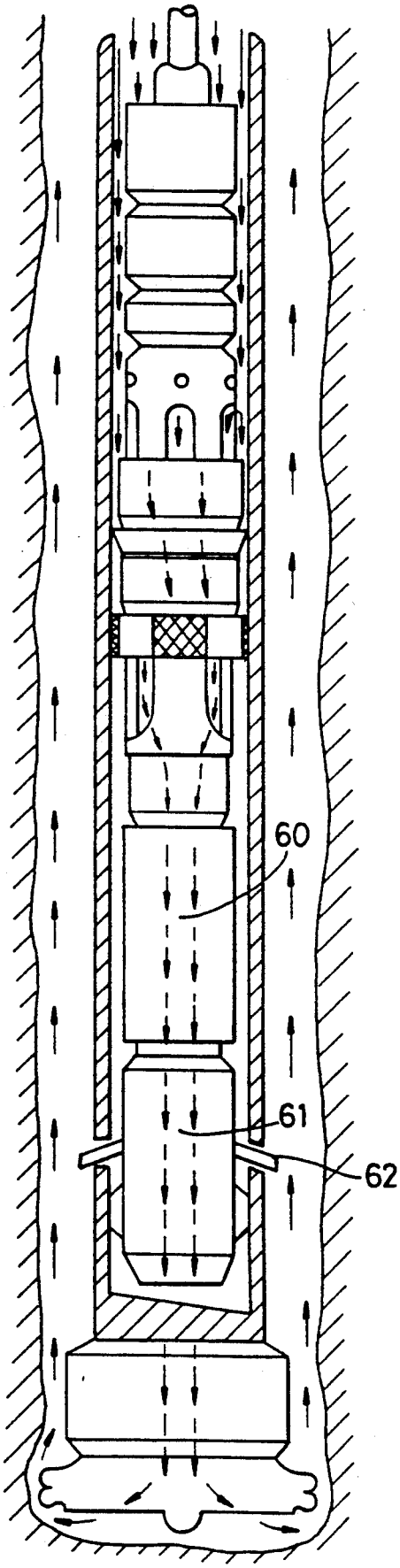

FIG. 2—is a longitudinal section through the actuator assembly of FIG. 1 to show an energising coil and magnetic plunger;

FIG. 3—is a longitudinal section through the anchor and sealing device of FIG. 1;

FIG. 4—is a cross section through the line IV to IV of FIG. 3;

FIG. 5—is a longitudinal section through an alternative embodiment of the actuator assembly to show an electric motor;

FIG. 6A and 6B—comprise together a longitudinal section through yet a further embodiment of an actuator assembly including an electric motor; and FIG. 7—is a schematic longitudinal section of the actuator of FIGS. 6A and 6B located in a well bore together with associated tooling and showing fluid flow directions.

Referring to FIG. 1, the wireline conveyed cutter assembly is shown suspended in a gas well tubing 3 and comprises an actuator assembly having an actuator 1 which has a socket 2 at its upper end for connection to an electric wireline 4, an anchor and sealing device 5 connected at its upper end to the lower end of the actuator 1, a down-hole motor 6 connected to the lower end of the outwardly pivotable blades 8 connected at the lower end of the down-hole motor 6, a stabiliser 9 connected at the lower end of the inside cutting 8, and a tubing puncher guide 10 connected at the lower end of the stabiliser and forming the lowermost portion of the cutting assembly in the tubing 3.

Referring to FIG. 2, the actuator assembly comprises an actuator housing having a cylindrical casing 11 with a cap 12 at its upper end and an actuator boot 13 plugging its lower end. Within the actuator casing and abutting between the cap 12 and boot 13 thereof is a cylindrical coil housing 14 around which is wound an electric energising coil 15 for forming an electromagnetic field therewithin. The electric coil 15 is connected to the wireline socket 2 which extends from the cap 12 of the actuator housing. An actuator 16 to 19 is movable electromagnetically and comprises a shaft 16 extending through the actuator boot 13 and having at its upper end, a magnetic plunger 17 (in the form of a cylindrical magnet) housed within the energising coil 15 and slidable between the cap 12 and actuator boot 13 of the actuator housing 11, 12, 13. The lower end of the shaft 16 is provided with a male connector 16*a* for connection with three radial fins 18 and a slip cone 19 connected thereto for cooperating with the anchor and sealing means 5 (FIG. 3).

The lower part of the actuator boot 13 has a connection 20 for connecting to a first end of a cylindrical body casing 21 of the anchor and sealing device 5. On the outside of the body 21 is a combined anchor and sealing member 22 to 24*a* which has a lower annular portion 22 having an upwardly facing annular shoulder 22*a* which abuts with a downwardly facing annular shoulder 21*a* of the body and is held fast by grub screws (not shown). A plurality of narrow deflectable wickers 23 extend upwardly from the outerhalf of the annular portion 22 and their inner surfaces 23*a* of their upper ends are spaced from the body. These inner surfaces 23*a* are inclined outwardly from the lower to the upper part thereof to receive the opposedly inclined surface of the slip cone (FIG. 3) and force the wickers 23 outwardly. The uppermost portion of the wickers 23 are connected by an annular rubber sealing member 24 having an outermost sealing lip 24*a*.

Three longitudinal slots 25 are provided in the body 21 of the slip and sealing device 5 (shown unsectioned in FIG. 3) and extend from midway down the wickers 23 to adjacent the upper end connecting piece 26 of the body 21. The fins 18 of the actuator 16 to 19 slide within the slots 25 to allow the slip cone 19 to slide along the outer surface of the body 21 of the slip and sealing device 5. Since the body is hollow, the slots 25 also communicate with the inner passage 27 thereof to allow mud to flow through the slip and sealing device 5.

In use the cutting assembly is conveyed on wireline down the tubing 3 to the designed point, which can be found by passing a signal along the wireline, and then the tubing puncher activated electronically to form a hole in the tubing and establish a full circulation of drilling mud through the tubing to be cut. The drilling mud is pumped between the cutter assembly and tubing 3. At this point a voltage is present over the coils 15 to hold the magnetic plunger 17 at the end of the actuator assembly 1 An increased voltage of reversed polarity is then applied generating a strong enough electromagnetic field in the coil 15 of the actuator assembly to move the magnetic plunger 17 from the upper end to the lower end of the coil 15 and thus move the fins 18 of the actuator down along the slots 25 of the body 21 of the anchor and sealing device 5. As a result the slip cone 19 engages in sealing contact under the wickers of the anchor and sealing member 22 to 24*a* forcing them outwardly into anchoring engagement with the inside wall of the tubing 3 and corresponding forcing the sealing member 24 into sealing engagement therewith. The lip 24*a* of the sealing member 24 helps to form a better seal with the tubing wall 3. In this arrangement the space between the inner wall of the borehole tubing 3 and the body of the anchor and sealing device is sealingly blocked by means of the slip cone 19 and the sealing member 24 to form a sealing means 19, 24, 24*a*. When mud is now pumped down the tubing 21, it is deflected by the sealing means 19, 24, 24*a* through the slip and sealing device (to by pass the sealing means 19, 24, 24*a*) via the slots 25 and the inner passage 27 of the body 21 to drive the hydraulic motor 6 and rotate the hydraulically pivotable cutters 8. The first motion is by the down-hole mud motor 6 which hydraulically rotates the cutter at speeds up to 650 rpm. The second motion is created by the circulating fluid which forces a piston (not shown) to open the cutter blades 8 hydraulically out with the body 3 of the cutter 7 and onto the wall of the tubing to be cut. (It will be appreciated that different bores of tubing can be cut but for convenience they are generally referred to as tubing). As a result the actuator assembly 1 and anchor and sealing device 5 are held stationary while the mud motor 6 and cutter rotate. The cutters 8 are held in cutting position until the seal formed by the sealing means 19, 24, 24*a* is broken and the mud thereby allowed to circulate outside the cutter assembly. To break the seal, a voltage of reverse polarity again is applied to the energising coil 15 thereby retracting the actuator 16 and 19 (and thus slip cone 19). The length of cut tubing can then be removed by standard technology.

In an alternative embodiment of the actuator 1 (FIG. 5), there is provided a thread gear type assembly driven by a D.C. servomotor. The coil of the motor (servo type directional D C Volts is designated by numeral 28 while the brush section of the motor is 29. Bearings are shown at 30 on either side of the motor 30, and a shaft with gear thread (female end) is shown at numeral 31. Other designations in the drawing are similar to those of FIG. 2. In the actuator of FIG. 5, the motor 28 drives the shaft 16, 31 upwards and downwards (or too and fro) to operate the slip cone 19 and deflect the drilling mud as before through the passage 27 of the anchor and sealing device 5. Again as before, the electric power (or signal) is supplied through the wireline 4.

FIGS. 6A and 6B show yet a further alternative embodiment in which a tear drop sub assembly 41 connected by wireline at top end, bottom end screwed and sealed by o-rings 48 into a tear drop sub adaptor 42. A plunger is located inside assembly 41 which activates an electric motor 43 held in position by a motor sub housing 47 by conducting a positive electric current from the wireline cable to the motor 43. Once the motor 43 is activated, a threaded shaft 49 which is connected to the bottom end of motor 43 by a hexagonal shape end will revolve through a threaded crows foot assembly 51. The thread shaft 49 is contained inside a Boot protector 45 which is held by means of threaded top and bottom connections between member 47 and main body 59. As added protection a rubber sleeve 46 is fitted over shaft 49 and held in position by a circlip groove 44. By rotating the shaft 49 through a threaded bush 51 (crows foot assembly), the motion causes an upper cone 52 to travel in a downward motion.

The upper cone 52 is then driven into a rubber seal 54 causing the rubber seal 54 to flair over, the same downward motion from the upper cone 52 pushes a lower cone 55 into a slip assembly 57 driving the metal wicker portion of the slips into the tubular bore, thus the rubber seal 54 and wicker slips 57 are activated. Once this assembly is activated against the wall of the wellbore tubular the whole electric wireline conveyed seal and anchor assembly, complete with attached mud motor and inside tubing cutter (FIG. 7) cannot be moved either in an upward or downward direction.

The aforementioned procedure describes how the electric wireline conveyed seal and anchor assembly is operated. This assembly is set at the desired point and full fluid circulation which had been previously established is shown in FIG. 7, the mud motor 60 can now be activated by downward fluid motion being diverted by the rubber seal 54 into and through the main body 59 I.D. and flow holes 50. The fluid being forced through the main body 59 at an increased pressure rate will then activate the mud motor 60. By connecting a downhole inside cutter 61 complete with outwardly pivotable cutting blades 62 to the mud motor 60 and by maintaining an increased fluid flow from the surface pump, a cutting action can be obtained by the rotation of the cutter 61 through the mud motor 60, with the fluid flow hydraulically forcing the cutting blades 62 out and through the wall of the tubular to be cut. Once the tubular is cut, the fluid will be cut off at the pump, with no further pressure forcing down the assembly, a spring inside the cutter body will expand causing the cutting blades 62 to retract back inside the cutter body. By reversing the electric current, the motor 43 activating the threaded shaft 49 will then be reversed causing the threaded shaft 49 to pull up the upper cone 52 assembly releasing the metal slip 57 profile and rubber seal 54 from the tubular bore. Once free, the whole assembly can be withdrawn to the surface by pulling up on the wireline.

The main advantages of the cutter assembly of the invention are:

- the speed with which the assembly can be lowered into position,;
- the positive method of locking onto the bore of the tubing complete with seal feature; and
- the speed with which the tubing can be cut and the cutting assembly can be retrieved from the borehole.

As shown in the abovementioned embodiment, the means sealing the space between the body of the anchor and sealing device and the tubing wall includes in effect the slip cone 19. In other embodiments this will form the whole sealing means for deflecting the flow of fluid.

Although the actuator in the above embodiment is moved electromagnetically, it will be appreciated that actuation can be effected by other magnetically controller, or electrically controlled, methods, such as by using an electric motor.

Furthermore, reference in the description to upper and lower should be construed with reference to the upper end of the anchor and sealing device being that end connectable by means to the wireline. Thus even if the device is almost horizontal in the borehole upper and lower will still have a directional meaning.

For the avoidance of doubt, reference hereinbefore to tubing cut by virtue of the invention, will also include, for example, other tubular members, casing and drill-pipe.

I claim:

1. A wireline conveyable device for a fluid operable borehole tubing assembly comprising a tubular body having a first end intended to form the upper end when in the borehole and a second open end intended to form the lower end, the tubular body including at least one aperture in a wall thereof to facilitate passage of fluid through the tubular body, electrically actuable outwardly moving anchoring means attached to the tubular body for positively locating the tubular member at a predetermined position within the borehole tubing, in use, and an electrically actuable sealing means attached to the tubular body and arranged, in use, for selectively sealing the space between the borehole tubing and the tubular body to divert fluid through the tubular body to bypass the sealing means for driving fluid actuable means located adjacent said second lower end of the tubular body.

2. A device as claimed in claim 1 wherein the sealing means is carried by the anchoring means which is movable outwardly from the tubular body to form an anchoring and sealing engagement with the inner wall of the borehole tubing.

3. A device as claimed in claim 2 wherein the combined anchoring and sealing means includes a plurality of outwardly deflectable members spaced around the outside of the tubular body, said members being fixed at a lower end to the tubular body and spaced therefrom at their upper ends, and an electrically actuable actuator including an annular deflector member slidably attached to the outside of the body and engagable on downward movement thereof with the upper ends of the deflectable members to deflect same outwardly into anchoring contact with the inner wall of the borehole tubing; and an annular sealing member carried by the upper ends of the deflectable members and engagable in sealing contact between the deflector member, on downward movement thereof, and the inner wall of the borehole tubing, to form the sealing means, in use.

4. A device as claimed in claim 3 wherein the annular deflector member is slidable in slots in the tubular body, the slots further acting as said aperture(s) via which, in use, fluid is diverted through the body to bypass the sealing means.

5. A device as claimed in claim 3 wherein there is further provided an actuator assembly including a housing connected to the upper end of the tubular body and housing the actuator therein; the actuator assembly further including an energisable coil connected to a socket for the wireline; and the actuator comprising a shaft carrying at its lower end the annular deflector member, and carrying a magnetic means at its upper end which is located within the conductor coil for effecting electromagnetic actuation of the actuator.

6. A device as claimed in claim 3 wherein there is further provided an actuator assembly including a housing connected to the upper end of the tubular body and housing the actuator therein; the actuator assembly further including an electric motor connected to a socket for the wireline; and the actuator comprising a shaft carrying the annular deflector member at its lower end and being actuable by means of the electric motor.

7. A fluid operable borehole cutting device comprising the wireline conveyable device as claimed in claim 1 and a fluid operable cutting assembly connected at the lower end of said tubular body.

8. A fluid operable borehole cutting device comprising the wireline conveyable deice as claimed in claim 6 and a fluid operable cutting assembly connected at the lower end of said tubular body.

9. A device as claimed in claim 4 wherein there is further provided an actuator assembly including a housing connected to the upper end of the tubular body and housing the actuator therein; the actuator assembly further including an energisable coil connected to a socket for the wireline; and the actuator comprising a shaft carrying at its lower end the annular deflector member, and carrying a magnetic means at its upper end which is located within the conductor coil for effecting electromagnetic actuation of the actuator.

10. A device as claimed in claim 4 wherein there is further provided an actuator assembly including a housing connected to the upper end of the tubular body and housing the activator therein; the actuator assembly further including an electric motor connected to a socket for the wireline; and the actuator comprising a shaft carrying the annular deflector member at its lower end and being actuable by means of the electric motor.

11. A fluid operable borehole cutting device comprising the wireline conveyable device as claimed in claim 2 and a fluid operable cutting assembly connected at the lower end of said tubular body.

12. A fluid operable borehole cutting device comprising the wireline conveyable deice as claimed in claim 3 and a fluid operable cutting assembly connected at the lower end of said tubular body.

13. A fluid operable borehole cutting device comprising the wireline conveyable deice as claimed in claim 4 and a fluid operable cutting assembly connected at the lower end of said tubular body.

14. A fluid operable borehole cutting device comprising the wireline conveyable deice as claimed in claim 5 and a fluid operable cutting assembly connected at the lower end of said tubular body.

* * * * *